United States Patent [19]

McConnell et al.

[11] Patent Number: 4,811,196

[45] Date of Patent: Mar. 7, 1989

[54] STEAM CONTROL SYSTEM AND METHOD

[75] Inventors: Marc D. McConnell, Nederland; Richard R. Edwards, Groves, both of Tex.

[73] Assignee: Texaco Inc., White Plains, N.Y.

[21] Appl. No.: 3,683

[22] Filed: Jan. 15, 1987

[51] Int. Cl.[4] ..... G05B 13/02; F01K 17/00

[52] U.S. Cl. ..... 364/148; 364/160; 364/161; 60/646; 60/686

[58] Field of Search ..... 364/148, 161, 160; 60/646, 686, 660; 415/17, 15

[56] References Cited

U.S. PATENT DOCUMENTS

| | | | |
|---|---|---|---|
| 4,096,699 | 6/1978 | Zitelli | 60/646 |
| 4,272,962 | 6/1981 | Viscovich et al. | 60/686 |
| 4,665,706 | 5/1987 | Russell et al. | 60/646 |
| 4,669,058 | 5/1987 | Schneider et al. | 364/148 |

*Primary Examiner*—John R. Lastova

*Attorney, Agent, or Firm*—Robert A. Kulason; James J. O'Loughlin; Ronald G. Gillespie

[57] ABSTRACT

The system and method of the present invention calls for reducing steam from one pressure down to a second pressure. Further, the steam st the one pressure is mixed with the steam at the second pressure. The mixed steam is provided for use in a process. The mixing of the steams is controlled in accordance with the providing of the mixed steam.

10 Claims, 1 Drawing Sheet

STEAM CONTROL SYSTEM AND METHOD

BACKGROUND OF THE INVENTION

Field of the Invention

The present invention relates to steam control systems and method for processes utilizing steam.

SUMMARY OF THE INVENTION

The system and method of the present invention calls for reducing steam from one pressure down to a second pressure. Further, the steam at the one pressure is mixed with the steam at the second pressure. The mixed steam is provided for use in a process. The mixing of the steams is controlled in accordance with the providing of the mixed steam.

The objects and advantages of the invention will appear more fully hereinafter from a consideration of the detailed description which follows, taken together with the accompanying drawings, wherein one embodiment of the invention is illustrated by way of example. It is to be expressly understood, however, that the drawings are for illustration purposes only and are not to be construed as defining the limits of the invention.

DESCRIPTION OF THE INVENTION

A crude distillation unit operates with three separate steam systems, high pressure (150 lb.), medium pressure (50 lb.), and low pressure (15 lb.). The low and intermediate pressure steams are used in the process, whereas the high pressure steam is used for its mechanical energy (i.e. to turn pumps). Mechanical energy is extracted by dropping pressure through a turbine. High pressure steam on the intake of the turbine results in intermediate pressure steam at the discharge. The greater the pressure drop, the more energy is extracted.

Figure 1:
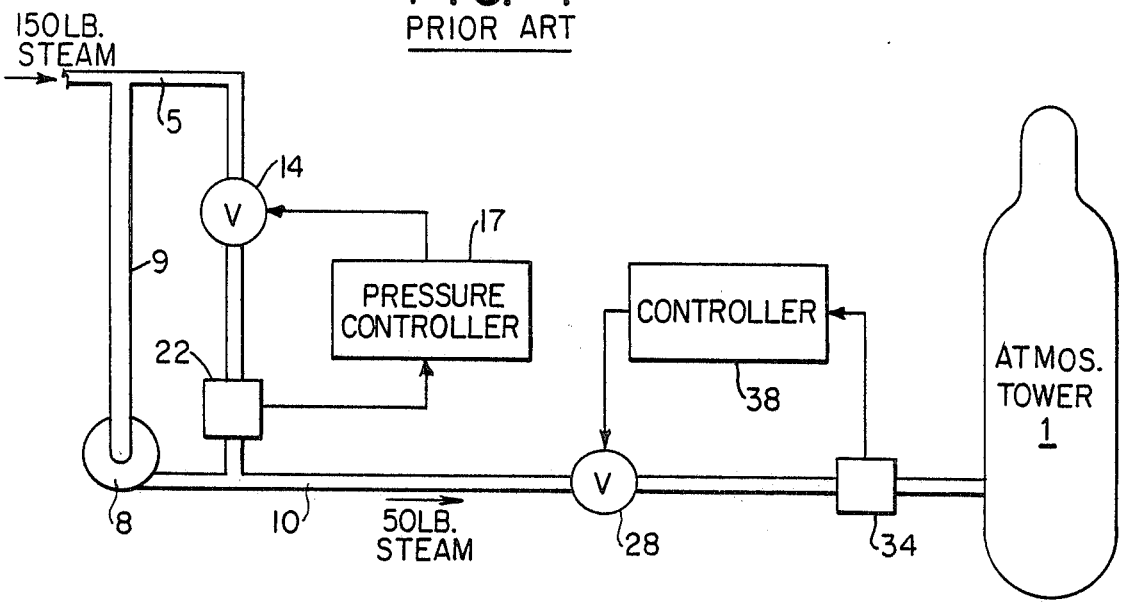
FIG. 1 PRIOR ART
FIG. 1 is a partial schematic and a partial simplified block diagram of a prior art control system for controlling steam entering an atmospheric tower.

With reference to FIG. 1 which depicts the prior art, 150 lb. steam enters line 5, a portion of which is provided to a turbine 8 by way of line 9. Turbine 8 discharges 50 lb. steam into a line 10. The remainder of the 150 lb. steam is provided to a valve 14 controlled by pressure controller 17. A pressure sensor 22 senses the pressure in line 5 beyond valve 14. Line 5 is connected to line 10 so that the discharge steam from turbine 8 and any steam utilized in a controlled manner from line 5 is provided to atmospheric tower 1.

Another point of control occurs in line 10 where valve 28 regulates the 50 lb. steam, provided to atmospheric tower 1, and is controlled by controller 38. A flow transmitter 34 provides a signal corresponding to the flow of steam in line 10, to controller 38 to aid in the control of the flow of 50 lb. steam to atmospheric tower 1. As can be seen in FIG. 1 there is no control exerted over controllers 17 and 38 other than the conventional manner of an operator setting the set points for those controllers directly.

Figure 2:
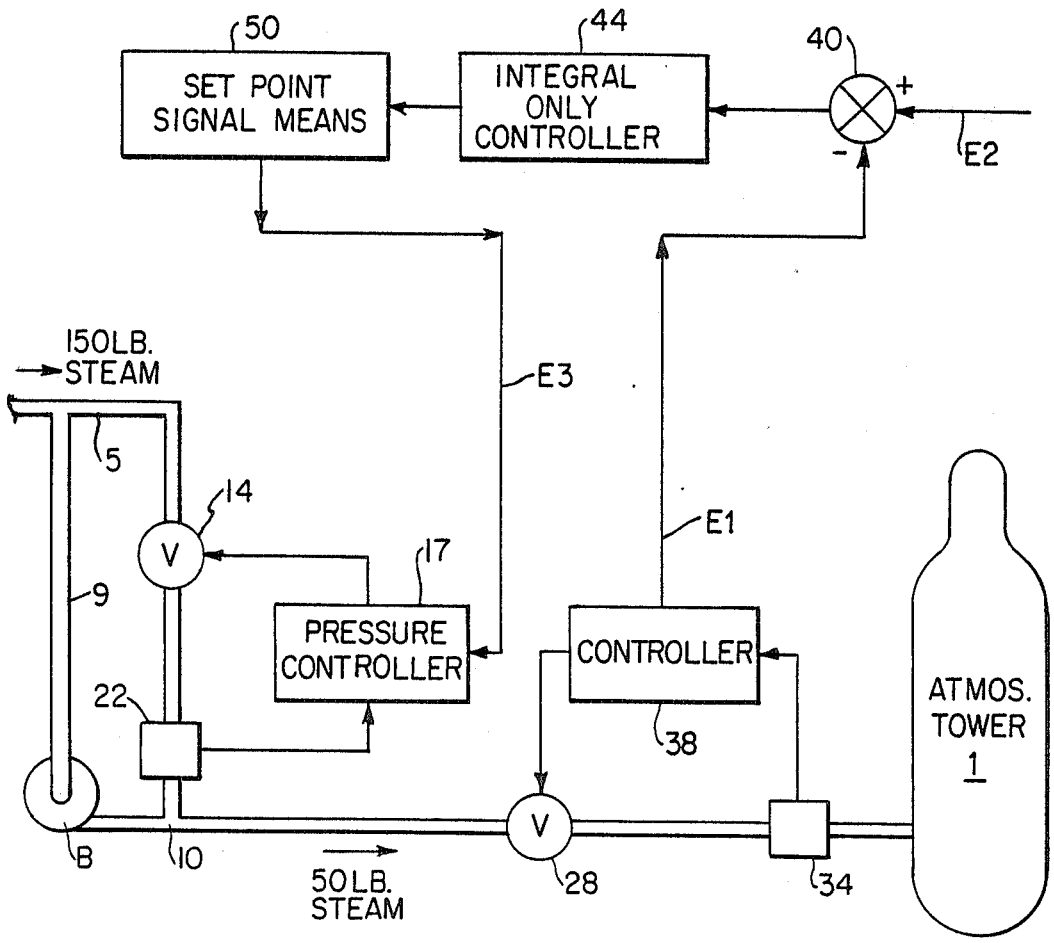
FIG. 2 is a partial schematic and a partial simplified block diagram of a steam control system constructed in accordance with the present invention.

The present invention automatically minimizes the intermediate steam pressure, within process constraints, to maximize the differential between the high pressure steam and the intermediate pressure steam and thus increase the efficiency of the steam turbines. Referring to FIG. 2, 150 lb. steam enters the system by way of a line 5, a portion of which enters turbine 8 by way of line 9 and provided as 50 lb. steam via line 10 to atmospheric tower 1. The 150 lb. steam in line 5 is controlled by valve 14 which is controlled by a pressure controller 17. Pressure controller 17 receives a signal corresponding to the pressure of the steam in line 5 beyond valve 14 from pressure sensor 22. The set point for pressure controller 17 is adjusted as hereinafter explained.

Line 5 also provides 150 lb. steam, when permitted to do so by valve 14, to line 10. The 50 lb. steam in line 10 is provided to valve 28. The steam flow in line 10 is sensed by flow sensor 34. Valve 28 is controlled by controller 38 which also provides a signal El corresponding to the position of valve 28. Sensor 34 provides a flow signal to controller 38. Signal E1 is provided to subtracting means 40. Subtracting means 40 receives a signal E2, which may be set by an operator, corresponding to a desired position for valve 28. In this example it is usually about 90 percent of full open. Subtracting means 40 provides a difference signal to an integral only controller 44 which provides an integrated signal to set point signal means 50. Set point signal means provides a set point signal E3 to control set point of pressure controller 17.

Although only a distillation tower as end use of the steam is discussed, it would be obvious to one skilled in the art that any process that utilizes medium pressure steam or low pressure steam derived from high pressure steam would be within the scope of the present invention.

What is claimed is:

1. A steam control system comprising:

means receiving steam at a first pressure for providing the steam at a second pressure, means receiving the steam at the first pressure for mixing the received steam with the steam at the second pressure, output means connecting to both receiving means for providing the mixed steam as output steam for use in a process, and control means connected to the mixing means and to the output means for controlling the mixing of the steams in accordance with the flow of the output steam and the pressure of the mixed steam.

2. A system as described in claim 1, wherein the first pressure is greater than the second pressure.

3. A system as described in claim 2, in which the mixing means includes:

pressure sensing means for sensing the pressure of the steam at the first pressure and providing a signal representative thereof, first valve means for controlling the flow of the steam at the first pressure to be mixed with the steam at the second pressure in accordance with a control signal, and first controller means connected to the pressure sensing means and to the first valve means for providing the control signal to the first valve means so as to control the flow of the steam at the first pressure in accordance with a set point signal.

4. A system as described in claim 3, in which the control means includes:

flow sensing means for sensing the flow of the output steam and providing a corresponding signal, second valve means for controlling the flow of the output steam in accordance with a control signal, second controller means connected to the flow sensing means and to the second valve means for providing the control signal to the second valve means in accordance with the signal from the flow sensing means and a preset set point and for providing a valve position signal representative of the second valve means position, and set point signal means connected to the first controller means and to the second controller means for providing the set point signal to the first controller means in accordance with the valve position signal from the second controller means.

5. A system as described in claim 4, in which the set point signal means includes:

difference means receiving a signal corresponding to a predetermined set point for the first controller means and receiving the valve position signal from the second controller means for providing a difference signal corresponding to the difference between the two received signals, integral means connected to the difference means for providing an integral signal corresponding to the integral of the difference signal, and network means connected to the integral means and to the first controller means for providing the set point signal to the first controller means in accordance with the integral signal from the integral means.

6. A steam control method comprising the steps of:

receiving steam at a first pressure, providing the received steam at a second pressure, mixing the received steam with the steam at the second pressure, providing the mixed steam as output steam for use in a process, and controlling the mixing of the steams in accordance with the flow of the output steam and the pressure of the mixed steam.

7. A method as described in claim 6, wherein the first pressure is greater than the second pressure.

8. A method as described in claim 7, in which the mixing step includes:

sensing the pressure of the steam at the first pressure and providing a signal representative thereof, controlling the flow of the steam at the first pressure to be mixed with the steam at the second pressure with first valve means in accordance with a control signal, and providing the control signal to the first valve means so as to control the flow of the steam at the first pressure in accordance with a set point signal.

9. A method as described in claim 8, in which the mixing control step includes:

sensing the flow of the output steam and providing a corresponding signal, controlling the flow of the output steam with second valve means in accordance with a control signal, providing the control signal to the second valve means in accordance with the signal from the flow sensing step and a preset set point, providing a valve position signal representative of the second valve means position, and providing the set point signal to the first controller means in accordance with the valve position signal from the second controller means.

10. A method as described in claim 9, in which the set point signal step includes:

receiving a signal corresponding to a predetermined set point for the first controller means, receiving the valve position signal from the second controller means, providing a difference signal corresponding to the difference between the two received signals, providing an integral signal corresponding to the integral of the difference signal, and providing the set point signal to the first controller means in accordance with the integral signal from the integral means.

* * * * *